United States Patent [19]

Hollingsworth et al.

[11] 4,274,487

[45] Jun. 23, 1981

[54] INDIRECT THERMAL STIMULATION OF PRODUCTION WELLS

[75] Inventors: Frank H. Hollingsworth, Tulsa, Okla.; George R. Jenkins, Edmonton, Canada; John W. Kirkpatrick; Lawrence N. Mower, both of Tulsa, Okla.

[73] Assignee: Standard Oil Company (Indiana), Chicago, Ill.

[21] Appl. No.: 2,495

[22] Filed: Jan. 11, 1979

[51] Int. Cl.[3] ..... E21B 43/24; E21B 43/243

[52] U.S. Cl. ..... 166/261; 166/251; 166/252; 166/272; 166/269

[58] Field of Search ..... 166/272, 278, 261, 51, 166/269, 263, 258, 251, 252, 52

[56] References Cited

U.S. PATENT DOCUMENTS

| | | | |
|---|---|---|---|
| 2,906,337 | 9/1959 | Hennig | 166/272 X |
| 2,994,375 | 8/1961 | Hurley | 166/261 X |
| 2,994,377 | 8/1961 | Trantham | 166/251 X |
| 3,062,282 | 11/1962 | Schleicher | 166/272 X |
| 3,097,690 | 7/1963 | Terwilliger et al. | 166/251 X |
| 3,272,261 | 9/1966 | Morse | 166/245 |
| 3,964,547 | 6/1976 | Hujsak et al. | 166/269 |
| 3,978,920 | 9/1976 | Bandyopadhyay et al. | 166/258 |
| 4,068,715 | 1/1978 | Wu | 166/269 X |
| 4,088,188 | 5/1978 | Widmyer | 166/269 |

*Primary Examiner*—Stephen J. Novosad
*Attorney, Agent, or Firm*—Fred E. Hook

[57] ABSTRACT

A well which is to produce from a heavy oil or tar sands reservoir is thermally stimulated from another well located on the order of 10 to 50 feet away. This adjacent thermal stimulation well can be considered expendable. This thermal stimulation is continued for a number of days, until the hot zone produced extends beyond the location of the production well. Thereafter, the adjacent thermal stimulation well preferably is closed off during the course of the frontal thermal drive or the like from remote injection wells. However, such stimulation may be repeated later of if the oil or tar becomes too viscous in the pay zone near the production well.

5 Claims, 2 Drawing Figures

INDIRECT THERMAL STIMULATION OF PRODUCTION WELLS

BACKGROUND OF THE INVENTION

General methods of completion of production wells in heavy oil or tar sand reservoirs, as practiced until a few years ago, are generally not pertinent to more recent work, including the invention disclosed below. A reference which appears to be of other than general significance is the L. E. Elkins U.S. Pat. No. 3,504,745. This patent teaches minimizing vertical passage of fluids outside a well by injecting into the path (which would otherwise be followed by such fluids) a foaming agent which can, for example, be an aqueous solution of any of a number of cited soaps, at a concentration in the order of 1 to 2%.

The T. S. Buxton, et al. U.S. Pat. No. 3,399,722 teaches creating separate upper and lower sets of perforations into a reservoir in a tar sand or heavy oil region. First, a zone of high permeability is created by combustion through the perforations at the lower part of the zone. After this has been carried on for several days, the zone is killed and the upper zone created by perforating. Production of heated material from the reservoir occurs through the upper zone. Accordingly, only one of these two zones (upper and lower zones of the reservoir) is used at one time. Our process intentionally uses flow of quite dissimilar fluids for different purposes into each of the two zones (upper and lower) simultaneously, in order to condition the production well for use in our invention.

R. M. Jorda shows a production well assembly for in situ combustion operations in U.S. Pat. No. 3,160,208. A number of perforations extend through the walls of two casing strings into a formation to be produced. Production resulting from in situ combustion enters these conduits and can be pumped from the well. Hot produced gases can flow out of the well through the annulus between a production string and the inner casing string. However, the inventor does not discuss means of conditioning the well prior to its use for ordinary production.

B. G. Harnsberger in U.S. Pat. No. 4,066,127, teaches circulating hot fluids out into the formation through a set of upper perforations into a reservoir and back through a set of lower perforations to form a void in the tar sands. This is followed by gravel packing the void, and injecting further hot fluids through the upper perforations to flow heated organic material from the reservoir through the gravel pack and a sand screen. This involves several disadvantageous procedures compared with ours. We provide for only outflow through the lower perforations, and never create a void in the reservoir by a melting process. This creates too many problems of sand movement through and near the void—and sand control is vital in production of tar sands and heavy oil from the usual unconsolidated reservoirs. There are other differences, but this is sufficient to show that these are quite different processes.

Finally, R. B. Needham in U.S. Pat. No. 4,068,717, provides a method for tar sands reservoir production using the difficult practice of employing steam to fracture from an injection to a production well in the reservoir. These steps do not otherwise condition the production well (which is the object of our invention). He uses the injection of steam, accompanied by a surface-active agent, to produce the reservoir, rather than a frontal thermal drive as employed by us.

It is thus apparent that these literature references considered alone or together, do not teach or suggest the essence of our invention, as summarized below.

ASSOCIATED APPLICATIONS

A patent application, Ser. No. 880,262 of Hollingsworth, has been filed under assignment to the same assignee. It shows an advantageous arrangement for a thermal frontal drive injection well suitable for use with this invention. Another application, Ser. No. 002,496 is being simultaneously filed herewith, entitled "Direct Combustion Stimulation of a Producing Well" by L. N. Mower and J. W. Kirkpatrick, assigned to this assignee. It covers another way to stimulate a producing well for use in a heavy oil or tar sand reservoir.

BRIEF DESCRIPTION OF THE DRAWINGS

In order to illustrate the embodiment of the invention described in the next section, two figures have been prepared. In these figures, the same reference numeral in both figures refers to the same or a corresponding part.

DESCRIPTION OF THE PREFERRED EMBODIMENT

Appraisal after several years of experimental operation of thermal recovery processes at a depth of the order of 1,000 feet in the McMurry formation of the Athabasca tar sands has indicated that the technological problems associated with warming the tar in the sands, transporting it from its original location to a producing well, and recovering it from that well are many, and in some cases quite difficult. Among others, it has been found that frequently only about a fifth of the combustion gas has been obtained in the returns, and production occurs over only an extremely small interval with corresponding high gas velocities, resulting in destruction of sand screens and other sand control devices. We have now recognized that another problem in frontal thermal drive which is of major importance is the need for preheating producing wellbores to encourage initial production of combustion gases and to increase flow capacity into the well. This allows such gases to enter the wellbore over a thick interval resulting in a moderate velocity which is nondestructive.

Direct wellbore stimulation has in the past been frequently carried out by local application of steam. Such stimulation has thus far proved less than successful. Often there is a gravel pack between the screen and the tar sand reservoir. The injection of steam to remove the tar and reduce its viscosity into such a production well has also frequently resulted in creation of voids in the unconsolidated sand, resulting in dissipation of the gravel pack which apparently migrates or flows into such voids.

Direct combustion stimulation of production wellbores has had some success. (See the copending application currently filled in the names of Mower and Kirkpatrick, Ser. No. 002,496.) However, the completion design for such single wellbore combustion stimulation (and subsequent production) is somewhat complex.

On the other hand, a producing wellbore can be indirectly thermally stimulated through an adjacent thermal stimulation well located a distance of the order of about 10 to about 50 feet away from the producing well. In this case said thermal stimulation well can, for most purposes, be considered expendable. That is, it will not be involved in the direct production process during most of the operating time of such a project. Hence the cost is low.

Figure 1:
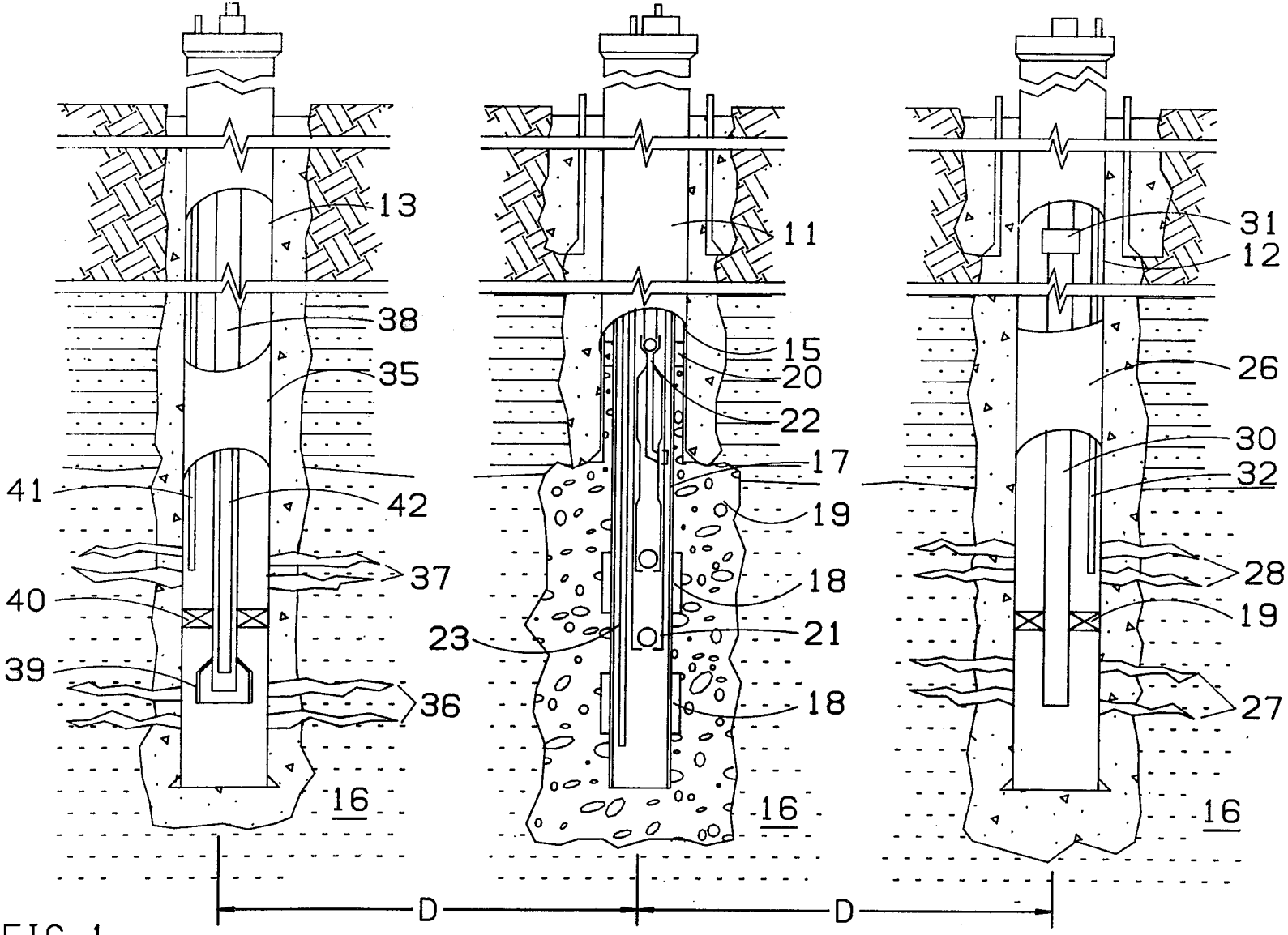
FIG. 1 shows in diagrammatic form a cross section of the earth with wells penetrating a heavy oil or tar sands reservoir, the wells being equipped for operations in accordance with this invention.

FIG. 1 shows a highly schematic diagram of a thermal stimulation well design for the purpose of indirectly thermally stimulating the producing well 11 either by the injection of steam through an adjacent well 12 or by compressed air flow from a well 13, which causes a local combustion front to be formed. It is to be understood that both of the wells 12 and 13 are not to be employed with a single producing well 11, but rather these are alternative designs. Either can be successfully employed. As the description proceeds, it will be found that the general scheme of operation and in fact the general arrangement of apparatus is mostly common between these two designs. For example, the adjacent well 12 or 13 may be equipped with a heat resistant alloy in the part extending through the reservoir (the producing zone) or (and this will usually be the case) it may be equipped with carbon steel casing throughout. In the later case, the casing may be run to total depth and cemented in the conventional manner, provided the casing is designed to have sufficient strength to withstand the thermal stresses imposed by the difference in temperature in the well. As an alternative, the casing string may be prestressed, as is well known in this art, to provide sufficient tension so that subsequent compressive stresses caused by thermal elongation between top and bottom of the well are insufficient to cause the casing to be in compression. A number of such wells of the design shown in FIG. 1 with prestressed carbon steel casing have been used successfully in steam stimulation of wells in the Athabasca tar sand from an adjacent well spaced approximately 10 to 50 feet, at a total depth of approximately 1100 feet.

The arrangement at the producing well 11 may be as shown in FIG. 1. In FIG. 1, the main string of casing 15 has been cemented at the top of the reservoir sand 16. Since the lower part of this cement will be exposed to relatively high temperatures, we used a high temperature cement mix to cement the casing to the surface.

Below the casing shoe, the hole is underreamed to allow a maximum amount of gravel packing. For instance, in the field example already referred to, 10.75 inch casing was cemented at the top of the lower McMurray tar sand, after which the well was underreamed to a diameter of about 15 inches to a total depth of approximately 1100 feet. This provided a volume for gravel pack of about twice that available without underreaming. Then a 5.5 inch liner 17 carrying a 5.5 inch wire wrapped screen overlayed with an 8.625 inch OD prepacked clinker cement screen (18) was run in the well. The sand control offered by this arrangement is considerable. The arrangement has already been described in U.S. Pat. Nos. 3,366,177 and 3,729,337. At the bottom of the liner is a bullplug or other means of blanking it off.

With the liner in place, the underreamed hole is filled with a gravel pack 19. Preferably, the length of the liner is such that additional gravel can be packed into the annular space between the casing 15 and the upper end of the liner 17, ending a few feet below the top of this liner. Then this last space is sealed off, preferably by pouring in a small amount of high temperature resistant cement slurry or alternatively by setting a packer at this point (20). The well is then ready for running in of the pump 21. The pump and its hollow sucker rod 22 are shown in more detail in FIG. 2.

Since it is always advantageous to monitor the temperature conditions in the part of the well most sensitive to thermal destruction, we prefer to run a thermocouple string (23) which may, for example, be a 1 inch tubing string in the annulus extended to near the bottom of the well.

The steam stimulator of adjacent well 12 similarly has casing 26 (note above discussion about use of carbon steel casing) which is cemented to a depth approaching that of the production well 11 using high temperature resistant cement. Perforations 27 on a lower level and 28 on an upper level in the heavy oil or tar sand reservoir 16 are made through the casing 26. These can, for example, be produced by use of an abrasive jet perforated technique. The lower perforations are to be used for injection of the steam, the upper for the injection of a divertant such as water or a dilute aqueous soap solution, as described below.

After the casing has been cemented in place and perforated, the steam injection tubing 30 (which may, for example, be 3 inch tubing) is run to a depth approaching that of the lower perforations 27. Near the bottom of the string is a thermal packer 19, and a distance of approximately 10 to 30 feet above this is located an expansion joint 31. This expansion joint takes care of axial motion which otherwise might cause buckling due to thermal elongation of the tubing string 30. A small thermocouple string 32, for example a string of one inch tubing, is run in above the packer. The packer divides this adjacent well 12 into two passage ways, a lower part connected to the surface through the tubing 30 and an upper part communicating with the upper part of the formation through the upper perforations and the annular space in the well 12.

In order to heat the formation using steam, it is simply necessary to force this steam through the tubing 31 and out through the perforations 27 into the lower part of the heavy oil or tar sand reservoir 16. While it is not always necessary, we prefer to eject simultaneously a stream of the divertant (for example at a rate of the order of 1 to 10 barrels/day) down through the annulus and out through perforations 28. This of course cools the upper zone of the reservoir and tends to cause the heated zone in the formation to spread out and away from well 12 in more or less a pancake fashion in the lower part of the reservoir.

Steam was furnished at a surface temperature of 500° F., to heat the formation to about 200° to 300° F. From about 10 to about 17 billion BTU of heat energy was injected in roughly 2 months, after which the wells were shut in for about 2 months. We believe the upper limit to heat energy injected should be at least 25 billion BTU, based on this experience.

If it is found that the initial injectivity through perforations 27 is inadequate, we can carry out a small hydraulic fracturing treatment through the tubing 30 at any time after packer 29 has been set. In this case we also prefer to use a stream of divertant injected through perforations 28 into the upper zone of the reservoir, because in that case this tends to cause the plane of the fracture to be roughly horizontal and confined to the lower part of the reservoir.

During this time of heat injection, as best we can tell from the thermocouple readings in the various wells on a 2.5 acre 5-spot pattern, the heated zone spreads out about radially along the lower part of the reservoir 16 until it finally encircles the lower part of the producing well 11. As soon as this has been accomplished, it is assumed that the reservoir around the injection well has been sufficiently heated so that a successful frontal thermal drive can be carried out.

The arrangement in the well 13 is another way of causing indirect stimulation through a twin well. In this case the stimulation is to be by local combustion drive. The casing 35 is cemented essentially as in well 12. In this illustration the bottom five joints of the 5.5 inch casing string were of a heat resistant alloy. Injection perforations 36 were made with a liquid jet perforating technique in the lower part of the well; an upper set 37 were similarly provided. Then a 3 inch tubing string 38 was run, carrying at its lower end a burner assembly such as shown in Hujsak U.S. Pat. No. 3,223,165 and above it a thermal packer 40. After the tubing 38 was run about to the position shown in FIG. 1, the packer 40 was set in the conventional manner. The usual thermocouple string 41 was run (1 inch tubing) with the thermocouple located near the upper perforations 37. A one inch gas injection tubing 42 was run inside of tubing 38 to mix the gas and air in the burner assembly and ignite the formation.

With the apparatus in place as shown, compressed air was forced through perforations 36 and simultaneously the stream of natural gas was turned on to permit combustion to occur inside the burner assembly. This heated gas stream containing oxygen, started a radial combustion drive adjacent the lower part of this well. In order to control upward movement of combustion gas and keep down the temperature around the upper part of the reservoir 16 and the well 13, a stream of divertant fluid was pumped through perforations 37 for the purposes and in the manner already described. The presence of a heat resistant alloy casing across the producing formation enhanced the ability to perform multiple stimulations, if such were necessary. It is to be understood of course that the local combustion front gradually spread out radially from adjacent the perforations 36 in a more or less pancake style into the lower part of the thick oil or tar sand reservoir 16. Operations of this sort were carried out for a period of the order of 10 to 90 days when the separation D is of the order of 10 to 50 feet, followed by a 1 to 4 day shut-in period to insure that the formation heating zone encircles the producing well 11, permitting it to produce the locally heated thick oil or melted tar and raise the flow capacity of this region, to minimize bypassing of combustion gas or hot tar or the like. The estimated heat energy in the combustion ranged from 1.8 to 4.1 billion BTU; this required injection of around 50 MMCF of air. A distinct limitation was keeping the production well temperature to not over 500° F. This can be accomplished by injecting cooling water into the producing well.

Both the wells 12 and 13 shown for the indirect stimulation accomplish essentially the same ultimate purpose: the lower part of the zone near the producing well is raised in flow capacity while high temperatures are kept away from the upper zone of the formation and the adjacent parts of the well.

Figure 2:
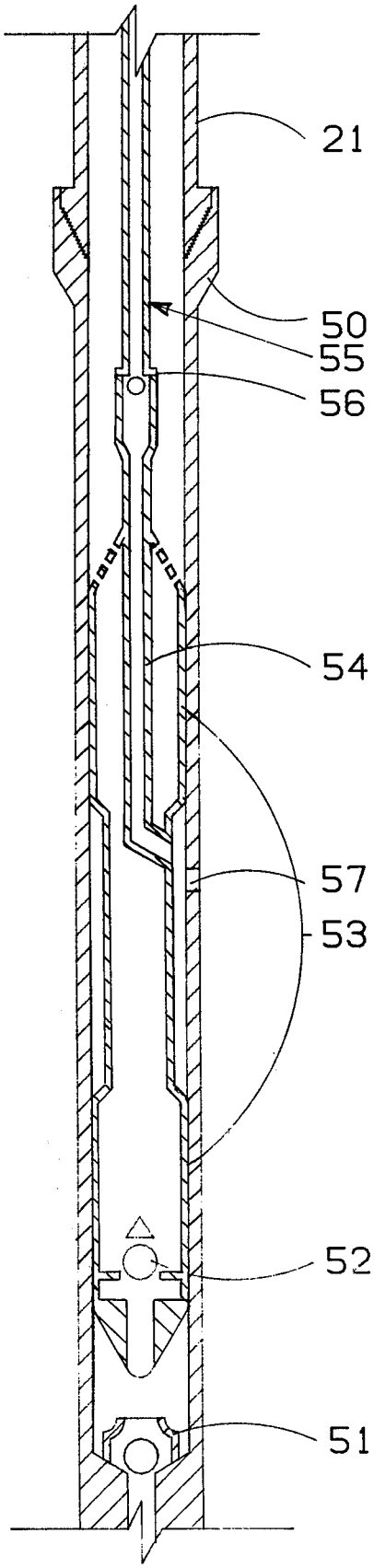
FIG. 2 is a diagrammatic representation of a hollow sucker rod pump which can be advantageously employed in the producing well associated with this invention.

A preferred arrangement of handling the pumping in the producing well is shown in FIG. 2. The tubing 21 carries the pump barrel 50, at the lower end of which is located a retrievable standing valve 51. The traveling valve 52 equipped with puller is mounted at the bottom of the plunger 53 which in this case is shown with two piston sections and an intermediate section of smaller diameter. A crossover tube 54 of relatively small diameter leads from this narrow zone to the connection to the sucker rods, where it connects fluid tight to the hollow sucker rods 55. Preferably mounted in the hollow sucker rods just above the pump is an injection check valve 56 preventing fluid flow up through the sucker rod tubing. In the pump barrel is mounted a check valve and perforation assembly 57 permitting fluid flow down the hollow sucker rod 55, through the crossover tube 54, and out through unit 57 past its check valve, which enables fluid to be pumped into the annular space by the pump. This permits the dilution of the thick oil or tar to a lower viscosity, which can be pumped out at the wellbore. It can also be utilized as a cooling water injection string to reduce operating temperatures in the wellbore.

It is apparent from the discussion that has been given above that the design for the adjacent well (well 12 or 13) accomplishes the desired purposes. These permit indirect thermal stimulation of the producing wellbore without causing serious damage thermally to the producing wellbore completion. Additionally, they permit indirect thermal stimulation of either new or existing producing wellbores which perhaps could not be directly stimulated due to the completion design used in them. As discussed above, this thermal stimulation could take place with either of two fluids, air for combustion or steam for steam injection. The designs permit injection of suitable divertant to encourage the formation of horizontal fractures low in the producing formation or to control upward movement of injected steam or combustion gas. Additionally, fluids can be forced through the hollow sucker rod of the producing pump to control temperatures in the producing well during passage of the process thermal front. In all cases—and this is very important—the system permitted simple producing well designs.

There are other benefits which can accrue from the location and operation of these twin well stimulating systems. These include, but are not limited to the following:

Control of permeability trends.

Improved distribution of principal process injection medium (either steam or air) by maintaining areas of high or low pressure.

Heating at one level in the formation can occur while production occurs at the same or at a different level in the producing well.

It is to be understood that we have discussed in detail as best we could our preferred embodiments for carrying out this invention. This was in the nature of an illustration, and no limitation is to be read into such discussion. The invention itself is best limited by the scope of the appended claims.

We claim:

1. A method of indirectly thermally stimulating a well to be used as a production well in a thermal frontal drive in a reservoir of heavy oil or tar sands comprising of the following steps:

a. installing in said well at said reservoir a casing carrying a sand screen and installing a gravel pack around said screen and adjacent said reservoir, said pack extending above the top of said screen, b. drilling an adjacent thermal stimulation well into said reservoir at a spacing ranging from about 10 to about 50 feet, and cementing casing in said well to at least the lowermost contact of said well and said reservoir, c. perforating said casing of said adjacent well into said reservoir at two vertically separated zones, the lower perforations into a lower part of said reservoir and upper perforations into an upper part of said reservoir, d. separately and simultaneously flowing an aqueous divertant through said upper perforations and forcing a thermal stimulating gas chosen from the group consisting of steam or an oxygen-containing gas through said lower perforations for in the order of 10 to 90 days, to permit local heating of organic matter in said reservoir around said production well, and e. producing hot organic matter from said reservoir through said production well to increase the flow capacity of fluids between a more distant thermal frontal drive injection well and said production well.

2. A method of indirectly thermally stimulating a production well in accordance of claim 1, including the step (following Step c of claim 1) of:

f. forming two separate fluid passages through said adjacent well, one communicating from the wellhead only with said lower perforations and the other communicating from said wellhead only with said upper perforations.

3. A method of indirectly thermally stimulating a production well in accordance with claim 2 including the step (following Step f of said claim 2) of:

g. running thermocouple tubing in the annulus of said adjacent well to a depth close to said upper perforations to permit monitoring the temperature in said adjacent well.

4. A method of indirectly thermally stimulating a well to be used as a production well in a thermal frontal drive in a reservoir of heavy oil or tar sands, comprising the following steps:

a. installing in said well at said reservoir a casing carrying a sand screen and installing a gravel pack around said screen and adjacent said reservoir, said pack extending considerably above the top of said screen and being sealed at the top thereof, b. drilling an adjacent thermal stimulation well into said reservoir at a spacing ranging from about 10 to about 50 feet and cementing casing in said well to at least the lower part of said reservoir, c. perforating said casing into said reservoir at two vertically separated zones, the lower perforations into a lower zone of said reservoir and the upper perforations into an upper part of said reservoir, d. forming two separate fluid passages through said adjacent well, one communicating from the wellhead only with said lower perforations and the other communicating form said wellhead only with said upper perforations by running in said well a string of tubing carrying near the lower end thereof a packer, and setting said packer between said lower and said upper perforations, e. separately and simultaneously propagating a local combustion front by air injection through said lower perforations and forcing an aqueous divertant liquid through said upper perforations, for a period in the order of 10 to 90 days, f. shutting in said adjacent well and said production well, to permit further heating of organic matter in said reservoir adjacent said production well, and g. producing hot organic matter from said reservoir into said production well to increase the flow capacity of fluids between a more distant thermal frontal drive injection well and said production well.

5. A method of indirectly thermally stimulating a well to be used as a production well in a thermal frontal drive in a reservoir of heavy oil or tar sands, comprising of the following steps:

a. installing in said well at said reservoir a casing carrying a sand screen and installing a gravel pack around said screen and adjacent said reservoir, said pack extending substantially above the top of said screen, and being sealed at the top thereof, b. drilling an adjacent thermal stimulation well into said reservoir at a spacing ranging from about 10 to about 50 feet and cementing casing in said well to the lowermost contact of said well in said reservoir, c. perforating said casing into said reservoir at two vertically separated zones, the lower perforations into the lower part of said reservoir and the upper perforations into the upper part of said reservoir, d. forming two separate fluid passages through said adjacent well, one communicating from the wellhead only with said lower perforations and the other communicating from said wellhead only with said upper perforations, e. separately and simultaneously forcing steam through said lower perforations and an aqueous divertant through said upper perforations, until steam containing heat energy in the range from approximately 10 to approximately 25 billion BTU has been injected into the lower part of said reservoir, and f. producing hot organic matter from said reservoir through said production well to increase the flow capacity of fluid between a more distant thermal frontal drive injection well and said production well.

* * * * *